US007610968B1

(12) United States Patent
Honsa

(10) Patent No.: US 7,610,968 B1
(45) Date of Patent: Nov. 3, 2009

(54) POWERED HAND TOOL

(75) Inventor: Thomas W. Honsa, Moline, IL (US)

(73) Assignee: Honsa Ergonomic Technologies, Inc., Milan, IL (US)

( * ) Notice: Subject to any disclaimer, the term of this patent is extended or adjusted under 35 U.S.C. 154(b) by 0 days.

(21) Appl. No.: 12/135,047

(22) Filed: Jun. 6, 2008

Related U.S. Application Data

(63) Continuation of application No. 11/482,132, filed on Jul. 6, 2006, now Pat. No. 7,401,662.

(51) Int. Cl.
*B25D 17/11* (2006.01)

(52) U.S. Cl. ..... 173/211; 173/162.1; 173/169; 173/170; 451/344

(58) Field of Classification Search ..... 173/210, 173/211, 162.1, 162.2, 170, 168, 169, 93, 173/93.5, 213, 218; 451/344, 354; 227/10, 227/156

See application file for complete search history.

(56) References Cited

U.S. PATENT DOCUMENTS 3,934,657 A * 1/1976 Danielson ..... 173/169
4,635,732 A * 1/1987 Gotsch et al. ..... 173/162.1
5,394,039 A * 2/1995 Suchdev et al. ..... 310/51
5,573,075 A * 11/1996 Henry et al. ..... 173/211
5,607,343 A * 3/1997 Keith et al. ..... 451/344
6,192,997 B1 * 2/2001 Tsai et al. ..... 173/211
6,234,256 B1 * 5/2001 Kettner ..... 173/210
6,668,942 B1 * 12/2003 Lin ..... 173/211
7,207,394 B2 * 4/2007 Young et al. ..... 173/218
7,401,662 B2 * 7/2008 Honsa ..... 173/211

* cited by examiner

*Primary Examiner*—Scott A. Smith
(74) *Attorney, Agent, or Firm*—Hamilton IP Law, PC.; Jay R. Hamilton; Charles A. Damschen

(57) ABSTRACT

A powered hand tool comprising a pneumatic motor including a cylinder, a main body formed as a hollow tube member, a main body rear end being formed with a fluid inlet and a fluid outlet, the main body being axially disposed for engagement with the pneumatic motor, a main body front end with an interior surface fitted for engagement with a lock nut, the pneumatic motor having a rotary shaft axially extending out of the main body front end wherein the diameter of the pneumatic motor is smaller than the diameter of the hollow tube member, an internal isolation layer composed of a vibration isolation material placed in the hollow tube member so that the vibration isolation material is engaged with and adjacent the ends of the hollow tube member and the pneumatic motor.

16 Claims, 7 Drawing Sheets

POWERED HAND TOOL

Applicant states that this utility patent application claims priority from U.S. patent application Ser. No. 11,482,132 and is a continuation of said utility patent application which was filed on Jul. 6, 2006 now U.S. Pat. No. 7,401,662 and is incorporated by reference herein.

FIELD OF INVENTION

The invention relates to vibration isolation and damping in hand tools. The embodiments shown and described herein are more particularly for isolating vibrations transferred to the user from the tool when using a pneumatic powered hand tool.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

DETAILED DESCRIPTION - LISTING OF ELEMENTS

| Element Description | Element Number |
|---|---|
| Main Body | 1 |
| Main Body Front End | 2 |
| Main Body Rear End | 3 |
| Fluid Passage | 4 |
| Rotary Shaft | 5 |
| Pneumatic Motor | 6 |
| Throttle Mechanism | 7 |
| Intentionally blank | 8 |
| Pneumatic Hand Tool | 9 |
| Lock Nut | 10 |
| Hollow Tube Member | 11 |
| Annular Space | 12 |
| Throttle Lever | 13 |
| Inlet Bushing | 14 |

-continued

DETAILED DESCRIPTION - LISTING OF ELEMENTS

| Element Description | Element Number |
|---|---|
| External Isolation Layer | 15 |
| Lock Ring | 16 |
| Collet Assembly | 17 |
| Stay Pin | 18 |
| Rear Thrust Plate | 19 |
| Front Thrust Plate | 20 |
| Front Bearing Support Plate | 21 |
| Cylinder | 22 |
| Intentionally blank | 23 |
| Internal Isolation Layer | 24 |
| Front Cap | 25 |
| Rear Cap | 26 |
| Pneumatic Motor Front End | 27 |
| Pneumatic Motor Rear End | 28 |
| Fluid Inlet Hole | 29 |
| Fluid Outlet Hole | 30 |
| Intentionally blank | 31 |
| Rear Bearing | 32 |
| Front Bearing | 33 |
| Machined Recess | 34 |

DETAILED DESCRIPTION OF THE INVENTION

Figure 1:
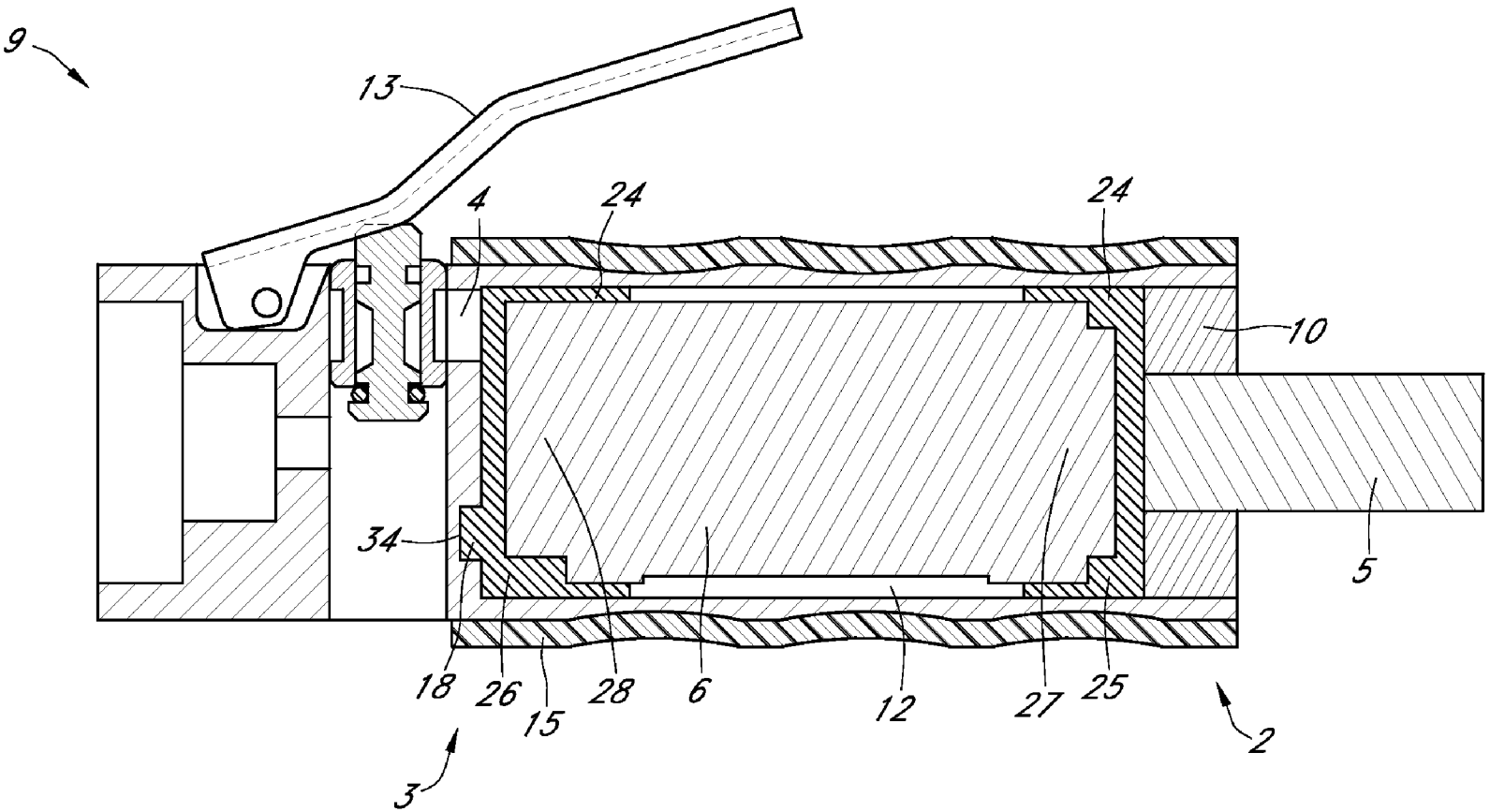
FIG. 1 shows an axial cross-sectional view of one embodiment of the present invention.

Referring now to the drawings, wherein like reference numerals designate identical or corresponding parts throughout the several views, FIG. 1 discloses and describes a vibration isolated pneumatic hand tool 9. When referring to FIGS. 1, 2, 3, 4B, 5B, 6B and 7B, the left side of the pneumatic hand tool 9 will be referred to as the rear of the pneumatic hand tool 9 and the right side of the pneumatic hand tool 9 will be referred to as the front of the pneumatic hand tool 9; additionally, the left side of elements axially disposed with the main body 1 will be referred to as the rear of the element while the right side of the element will be referred to as the front of the element. The pneumatic hand tool 9 in the embodiment shown in FIG. 1 includes a main body 1 formed as a hollow tube member 11. The main body rear end 3 includes a fluid passage 4 to allow fluid to move into and power the pneumatic motor 6. In addition to compressed air, the power source may also be selected from the group consisting of electricity or other compressed fluids, such as steam or nitrogen.

The pneumatic motor 6 is of the type well known to those skilled in the art, and may be of 0.3, 0.6 or 1.0 horsepower, depending on the embodiment. Accordingly, the present invention is not limited by the power rating of the pneumatic motor 6. The fluid flow to the pneumatic motor 6 is controlled via the throttle mechanism 7, for which the throttle lever 13 provides the user interface. The throttle mechanism 7 and throttle lever 13 are one type of work control means for controlling the work generating means as recited in the claims.

Figure 2:
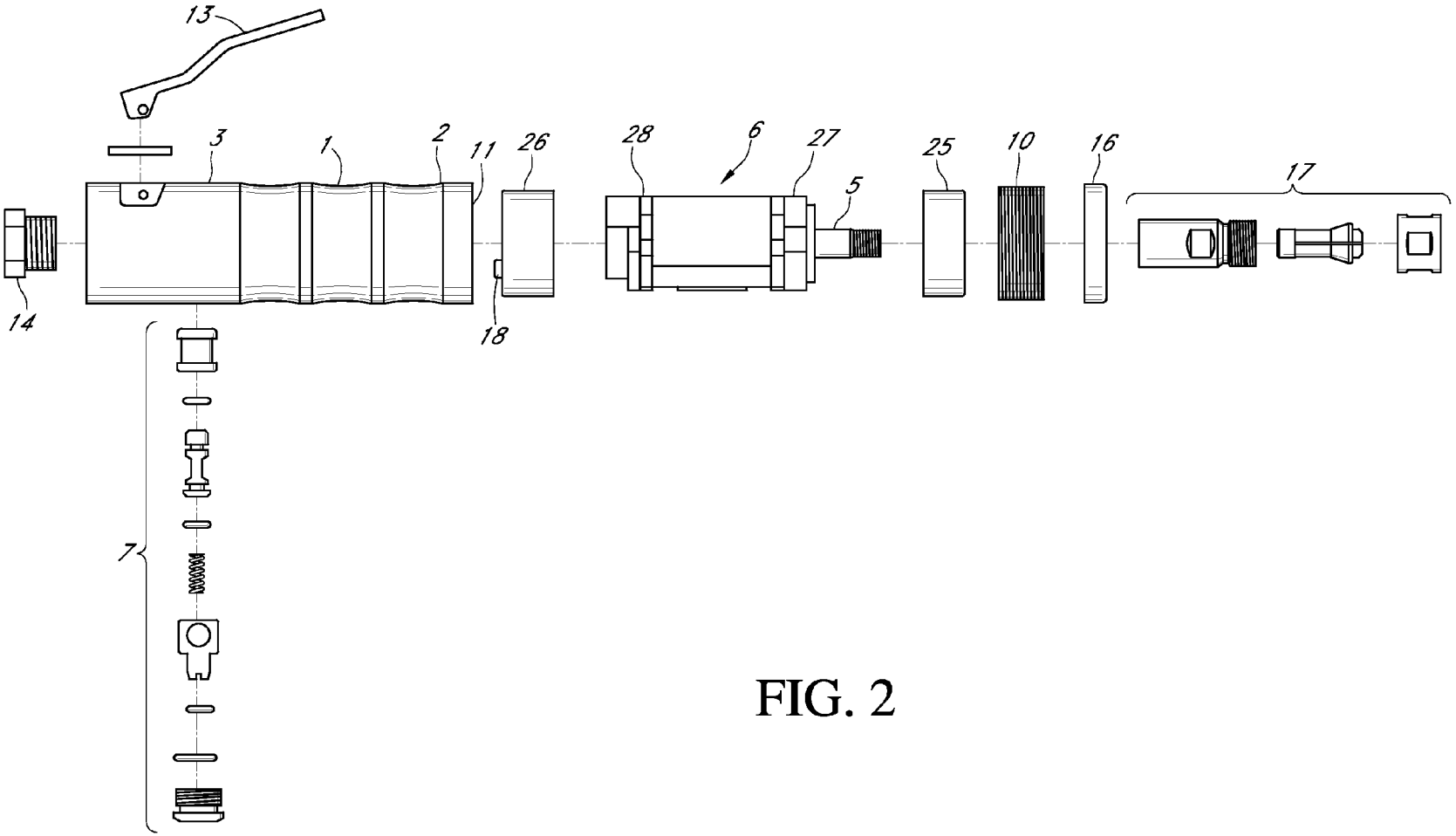
FIG. 2 shows a blow-up of one embodiment of the present invention.
Figure 3:
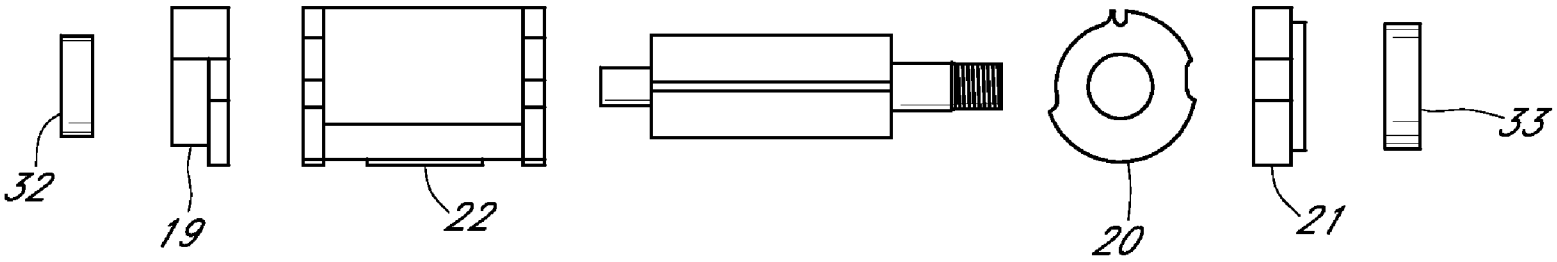
FIG. 3 shows a blow-up of the pneumatic motor in one embodiment.

In the embodiment shown in FIGS. 1, 2 and 3, the pneumatic motor rear end 28 is comprised of a rear thrust plate 19 and a rear bearing 32, of the type well known to those skilled in the art, engaged with the rear end of a cylinder 22. The pneumatic motor front end 27 is comprised of a front thrust plate 20, a front bearing support plate 21 and a front bearing 33, of the type well known to those skilled in the art, engaged with the front end of said cylinder 22. The rear bearing 32 has a smaller outer diameter than the inner diameter of the rear thrust plate 19, and in the embodiment shown in FIG. 3, the axial dimension of the rear bearing 32 is less than or equal to the axial dimension of the rear thrust plate 19 so that the rear bearing 32 completely seats within the rear thrust plate 19. The rear bearing 32 engages both the rear end outer surface of the rotary shaft 5 and the inward surface of the rear thrust plate 19 so that the rear thrust plate 19 does not rotate with respect to the rotary shaft 5. The front bearing 33 has a smaller outer diameter than the inner diameter of the front bearing support plate 21, and in the embodiment shown in FIG. 3, the axial dimension of the front bearing 33 is less than or equal to the axial dimension of the front bearing support plate 21 so that the front bearing 33 completely seats within the front bearing support plate 21. The front thrust plate 20 emulates the outward circumferential shape and size of the front bearing support plate 21, and in the embodiment shown in FIG. 3, is axially positioned between and held stationary by the cylinder 22 and the front bearing support plate 21. The front bearing 33 engages both the front end outer surface of the rotary shaft 5 and the inward surface of the front bearing support plate 21 so that neither the front bearing support plate 21 nor the front thrust plate 20 rotate with respect to the rotary shaft 5.

The main body 1 is axially disposed with the pneumatic motor 6. The rotary shaft 5 of the pneumatic motor 6 extends axially from the main body front end 2. A collet assembly 17 is engaged with the rotary shaft 5 on the rear end of the collet assembly 17 (as shown in FIG. 2). The collet assembly 17 is able to engage a plurality of rotational tools such as a bit, a grinding wheel or a cutter on its front end, as is known to those skilled in the art. The collet assembly 17 is one means of coupling a tool to the rotary shaft 5 as recited in the claims. A lock nut 10 is fashioned, most commonly with threads on the circumferentially outward surface, to engage both the circumferentially inward surface of the main body front end 2 and to engage a portion of the pneumatic motor front end 27 in such a way as to fix the axial position of the pneumatic motor 6 with respect to the main body front end 2. This is most commonly achieved via threads on a portion of the pneumatic motor front end 27 that engage threads on the lock nut 10, but other means may be used by those skilled in the art. In one embodiment, a lock ring 16 is fitted with threads on the circumferentially inward surface for engagement with a portion of the circumferentially outward threads on the lock nut 10 so that when the lock ring 16 is tightened against the main body front end 2, the lock nut 10 is held in place by the lock ring 16.

In the present invention an internal isolation layer 24 is placed between the pneumatic motor 6 and the main body 1 in order to minimize the number and magnitude of vibrations transferred from the pneumatic motor 6 to the main body 1. Additionally, the internal isolation layer 24 provides noise reduction associated with vibrations caused by operation of the pneumatic hand tool 9. The internal isolation layer 24 may be fashioned to eliminate any metal on metal contact between the main body 1 and the pneumatic motor 6. In the embodiment shown in FIG. 1, an external isolation layer 15 is placed on the external surface of the main body 1 in order to minimize the number and magnitude of vibrations transferred from the main body 1 to the user. The external isolation layer 15 also serves to provide comfort to the user's hand and a better grip on the pneumatic hand tool 9. Further benefits of the external isolation layer 15 are that it serves to reduce sound generated by operation of the pneumatic hand tool 9 and acts as a temperature insulator between the main body 1 and the user's hand. The internal isolation layer 24 is one means of reducing the number and magnitude of vibrations transferred from the work generating means to the main body 1 as recited in the claims.

In the embodiment shown in FIGS. 1 and 2, the internal isolation layer 24 consists of two caps, a front cap 25 and a rear cap 26, with an annular space 12 disposed axially between the front cap 25 and the rear cap 26. The front cap 25 is formed so as to fully engage both the pneumatic motor front end 27 circumferentially outward surface 6 and the circumferentially inward surface of the main body front end 2 so that the front cap 25 and the circumferentially inward surface of the main body front end 2 fix the radial position of pneumatic motor front end 27 with respect to the main body front end 2. In the embodiment shown in FIG. 1, the front cap 25 extends axially over the front thrust plate 20, front bearing support plate 21 and the small portion at the front of the cylinder 22 that has an outer circumferential shape that emulates the outer circumferential shape of the front thrust plate 20. When the pneumatic hand tool 9 in the embodiment shown in FIG. 1 is fully assembled, the rear surface of the lock nut 10 is engaged with the front surface of the front cap 25, preventing movement towards the main body front end 2 within the hollow tube member 11.

Figure 8:
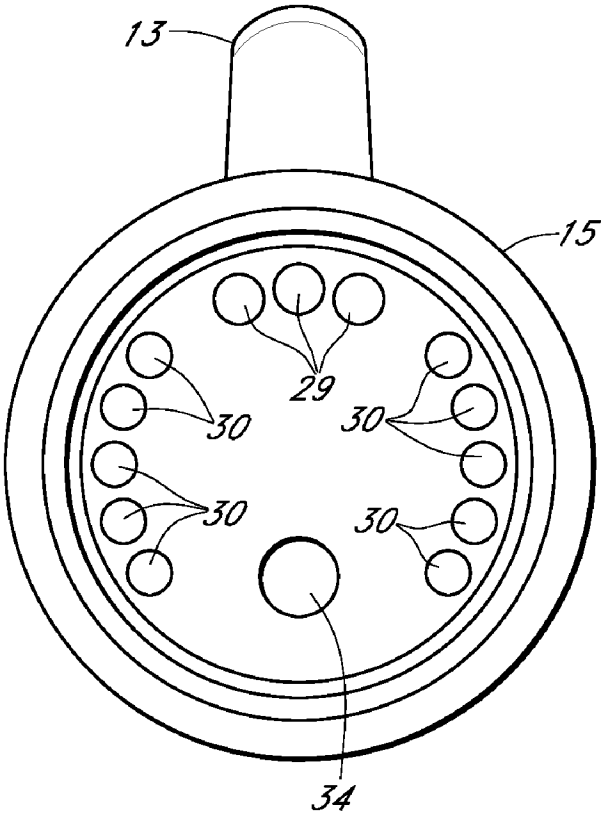
FIG. 8 shows a radial cross-sectional view of the main body rear end of one embodiment of the present invention.
Figure 10:
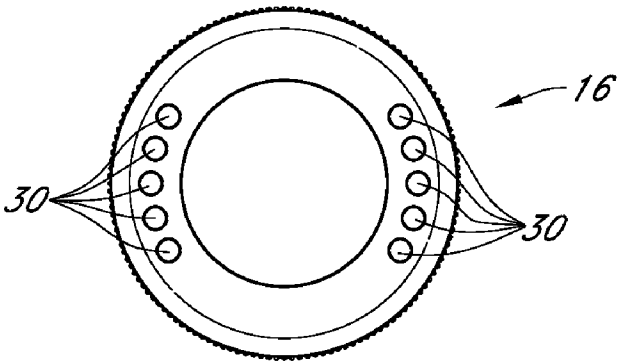
FIG. 10 shows one embodiment of the lock ring fashioned for front end exhaust
Figure 9:
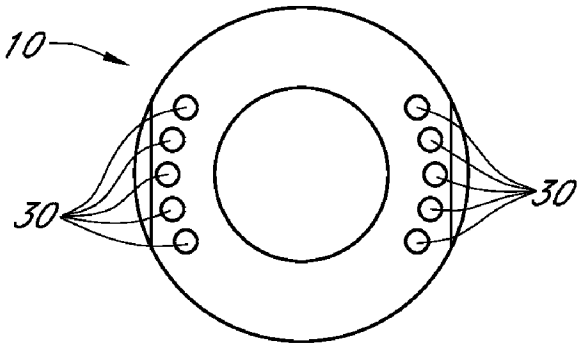
FIG. 9 shows one embodiment of the lock nut fashioned for front end exhaust.

The rear cap 26 is formed so as to fully engage both the pneumatic motor rear end 28 circumferentially outward surface and the circumferentially inward surface of the main body rear end 3 so that the rear cap 26 and the circumferentially inward surface of the main body rear end 3 fix the radial position of the pneumatic motor rear end 28 with respect to the main body rear end 3. In one embodiment, the rear cap 26 extends axially over the rear thrust plate 19 and the small portion at the rear of the cylinder 22 that has an outer circumferential shape that emulates the outer circumferential shape of the rear thrust plate 19. The rear cap 26 is also formed with a stay pin 18 that engages a machined recess 34 in the main body rear end 3 to ensure that only the rotary shaft 5 rotates with respect to the main body 1 when the pneumatic motor 6 is energized, preventing the pneumatic motor 6 from rotating with respect to the main body 1. When the pneumatic hand tool 9 in the embodiment shown in FIG. 1 is fully assembled, the portion of the main body rear end 3 that is transverse with respect to the rotary shaft (that portion in which the machined recess 34 is located and shown in FIG. 8) is engaged with the rear surface of the rear cap 26 so that any corresponding fluid inlet holes 29 and/or fluid outlet holes 30 in the rear cap 26 and the main body rear end 3 are properly aligned for communication. This engagement also prevents any element within the hollow tube member 11 from moving towards the main body rear end 3. Additionally, this engagement, in conjunction with the front cap 25 and the lock nut 11, fixes the axial position of the pneumatic motor 6 within the main body 1.

The front cap 25 and rear cap 26 are composed of a vibration isolating material, such as an elastomeric ether or ester based polyurethane, or an elastomeric vinyl, suitable for the specific pneumatic hand tool 9 the front cap 25 and rear cap 26 are to be used with. The material of the internal isolation layer 24 is chosen depending on the frequency of vibrations the pneumatic hand tool 9 generates and the typical operating temperatures of the pneumatic hand tool 9. In the embodiment shown in FIG. 1, a material with a shore A hardness between 45 and 70 is most effective for minimizing the vibrations transferred from the pneumatic motor 6 to the main body 1 at ambient temperature. The internal isolation layer 24 acts as a shock absorber between the pneumatic motor 6 and the main body 1 to minimize the number and magnitude of vibrations transferred from the pneumatic motor 6 to the main body 1. In the embodiment shown in FIGS. 1 and 2, the internal isolation layer 24 ensures that there is no metal to metal contact between the main body 1 and pneumatic motor 6, which also reduces the amount of sound generated during operation of a pneumatic hand tool 9. In the embodiment shown in FIG. 1, the front cap 25 and rear cap 26 are of such an axial dimension as to allow for a predetermined amount of annular space 12 between the axial portions of the front cap 25 and rear cap 26. The annular space 12 provides an area for exhaust fluid to be discharged from the pneumatic motor 6. The front cap 25 and rear cap 26 may be slightly compressed in the embodiment shown in FIG. 1 depending on the degree of axial force used to secure the lock nut 10 and/or lock ring 16 within the main body 1.

Figure 4C:
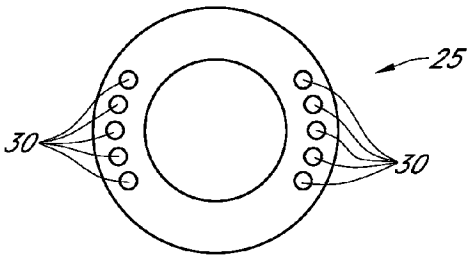
FIGS. 4A, 4B and 4C show three views of the front cap of the internal isolation layer fashioned for front end exhaust.
Figure 4B:
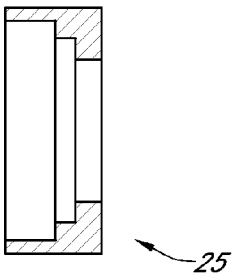
Figure 4A:
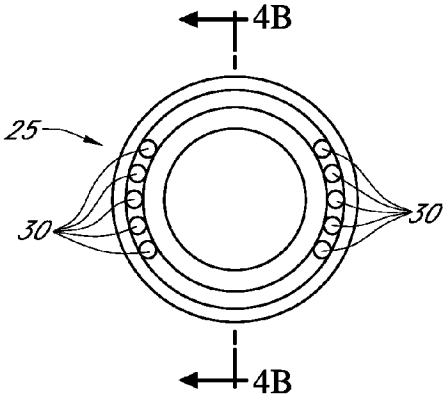
Figure 5C:
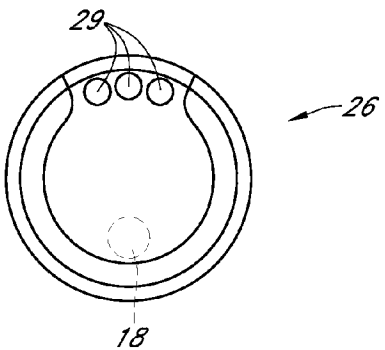
FIGS. 5A, 5B and 5C show three views of the rear cap of the internal isolation layer fashioned for front end exhaust.
Figure 5B:
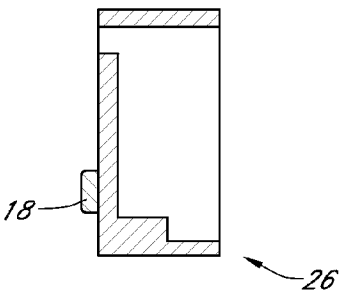
Figure 5A:
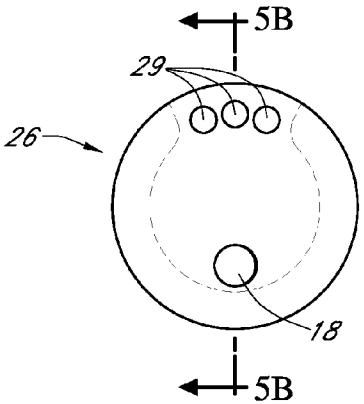
Figure 6A:
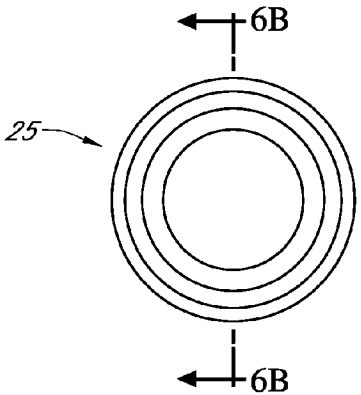
FIGS. 6A, 6B and 6C show three views of the front cap of the internal isolation layer fashioned for rear end exhaust.
Figure 6B:
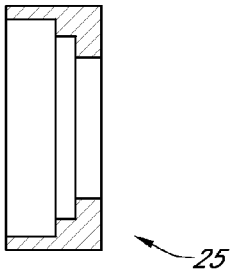
Figure 6C:
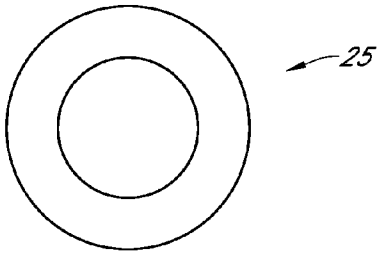
Figure 7A:
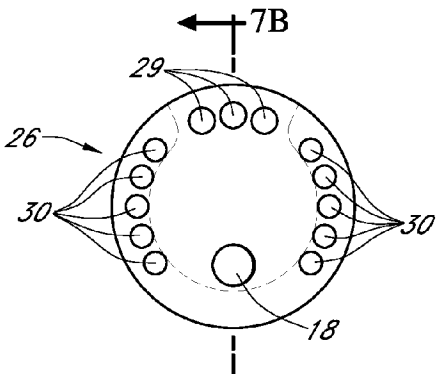
FIGS. 7A, 7B, and 7C show three views of the rear cap of the internal isolation layer fashioned for rear end exhaust.
Figure 7B:
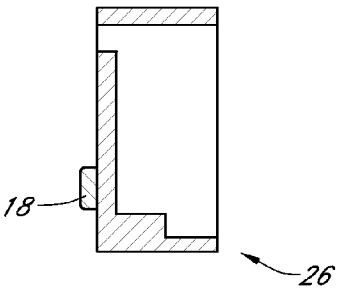
Figure 7C:
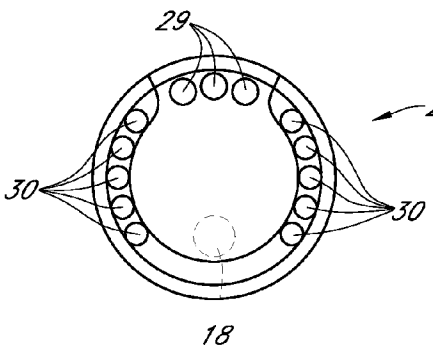

The invention allows pneumatic hand tools 9 to be specified as rear end exhaust or front end exhaust. The internal isolation layer 24 is ported to communicate with different fluid inlet holes 29 and fluid outlet holes 30 in the main body 1, lock nut 10 or lock ring 16, depending on the specified exhaust location. In a rear end exhaust pneumatic hand tool 9 (for which one embodiment of the front cap 25 is shown in FIGS. 6A, 6B and 6C; and for which one embodiment of the rear cap 26 is shown in FIGS. 7A, 7B and 7C), the rear cap 26 is formed with fluid inlet holes 29 that correspond to fluid inlet holes 29 in the main body rear end 3. The rear cap 26 is further formed with fluid outlet holes 30 that correspond to fluid outlet holes 30 machined into the main body rear end 3 (see FIG. 8). The fluid outlet holes 30 machined in the main body rear end 3 communicate with corresponding fluid passages (not shown) in the inlet bushing 14 to exhaust spent fluid to the atmosphere as in designs currently available and well known to those skilled in the art. In a rear end exhaust embodiment, the exhaust passes from the pneumatic motor 6 to the annular space 12, through the outlet holes 30 in the rear cap 26 and through the outlet holes 30 in the main body rear end 3 to the fluid passages (not shown) in the inlet bushing 14, from where the exhaust is discharged to the atmosphere. In a front end exhaust pneumatic hand tool 9 (for which one embodiment of the front cap 25 is shown in FIGS. 4A, 4B and 4C; and for which one embodiment of the rear cap 26 is shown in FIGS. 5A, 5B and 5C), the rear cap 26 is formed with fluid inlet holes 29 that correspond to fluid inlet holes 29 machined in the main body rear end 3, but the rear cap 26 has no fluid outlet holes 30 in this embodiment (see FIGS. 5A and 5C). The front cap 25, lock nut 10 and lock ring 16 are formed with corresponding fluid outlet holes 30 (see FIGS. 4A, 4C, 9 and 10), so that spent fluid exhausted into the annular space 12 passes through the fluid outlet holes 30 in the front cap 25 and the corresponding fluid outlet holes 30 in the lock nut 10 and lock ring 16, from where the exhaust is discharged to the atmosphere.

The present invention allows for the front cap 25 and rear cap 26 of the internal isolation layer 24 to be easily disengaged from a pneumatic motor 6 if the pneumatic motor 6 becomes dysfunctional. The front cap 25 and rear cap 26 may then subsequently be easily engaged with a properly functioning pneumatic motor 6. The front cap 25, rear cap 26 and the properly functioning pneumatic motor 6 may easily be fitted inside the original main body 1. Consequently, the main body 1, front cap 25 and rear cap 26 may be used with a plurality of pneumatic motors 6. Using the present invention, the pneumatic motor 6 of a pneumatic hand tool 9 may easily be removed and replaced or serviced without refitting the main body 1 with new or additional components to the internal isolation layer 24 or external isolation layer 15. This allows for easily servicing the pneumatic motor 6 of a pneumatic hand tool 9 employing the disclosed internal isolation layer 24 and/or external isolation layer 15. Embodiments of the present invention include, but are not limited to, pneumatic hand tools 9 using a 0.3, 0.6 or 1.0 horsepower pneumatic motor 6. The pneumatic motor 6 as shown is one type or means of generating work, as recited in the claims, which may also be connected to other power sources such as an internal combustion system as recited in the claims.

In the embodiment shown in FIG. 1, the external isolation layer 15 is engaged with the circumferentially outward portion of the main body 1 and occupies the surface of the main body 1 that is in contact with the user when the pneumatic hand tool 9 is in operation. The external isolation layer 15 need not engage the entire circumferentially outward surface of the main body 1, but may be fashioned to engage such area of the circumferentially outward surface of the main body 1 that provides the user interface without interfering with the operation of the throttle lever 13. The external isolation layer 15 may be affixed to the main body 1 by any means known to those skilled in the art, or it may be molded to the shape of the main body 1 for an interference fit between the main body 1 and the external isolation layer 15. In the embodiment shown in FIG. 1, the external isolation layer 15 is fashioned of a thickness between one-eighth of an inch and three-sixteenths of an inch to minimize vibrations associated with a specific type or style of pneumatic hand tool 9 or to alleviate the symptoms associated with hand fatigue of a specific physical ailment. In this way, the external isolation layer 15 acts as a shock absorber between the main body 1 and the user to minimize the number and magnitude of vibrations transferred from the main body 1 to the user. The external isolation layer 15 also minimizes the hand fatigue experienced by the user during operation of the pneumatic hand tool 9 while simultaneously providing for a better grip. The external isolation layer 15 also reduces the amount of sound generated during operation of a pneumatic hand tool 9 and acts as a temperature insulator between the main body 1 and the user during operation. The material for the external isolation layer 15 is chosen in the same manner as the material for the internal isolation layer 24. In some embodiments, such as the one disclosed in FIG. 1, the external isolation layer 15 and the internal isolation layer 24 are constructed of a similar material. In the embodiment shown in FIG. 1, the main body 1 is formed in an ergonomic wave contour and the external isolation layer 15 follows that same ergonomic wave contour so that the user's fingers may engage the trough of the wave contour, thereby further reducing the resulting amount of fatigue in the user's hand after operation of the pneumatic hand tool 9. The external isolation layer 15 and ergonomic wave contour as shown are one means of surrounding the main body 1, as recited in the claims.

It should be noted that the present invention is not limited to the specific embodiments pictured and described herein, but is intended to apply to all similar apparatuses for minimizing the number and magnitude of vibrations transferred from a pneumatic hand tool 9 to the user during operation. Accordingly, modifications and alterations from the described embodiments will occur to those skilled in the art without departure from the spirit and scope of the present invention.

What is claimed is:

1. A powered hand tool comprising:

a. a pneumatic motor;

b. a rotary shaft affixed to said pneumatic motor;

c. a main body formed as a hollow tube member and axially disposed for engagement with said pneumatic motor, said main body comprising:

i. a main body rear end;

ii. a main body front end, wherein said rotary shaft protrudes from said main body front end;

iii. a fluid inlet;

d. an internal isolation layer, said internal isolation layer positioned in said main body adjacent the circumferentially inward surface of said main body front end and the circumferentially outward surface of said pneumatic motor;

e. a lock nut engaging said main body front end fixing the position of said pneumatic motor front end within said main body;

f. an inlet bushing engaging said fluid inlet of said main body; and g. a throttle mechanism to control operation of said pneumatic motor.

2. A powered hand held tool as set forth in claim 1 wherein said internal isolation layer is further defined as two portions comprising:

a. a rear cap formed to engage a portion of the outer surface of the rear end of said pneumatic motor, said rear cap formed with a stay pin to engage a machined recess in said main body rear end; and b. a front cap formed to engage a portion of the outer surface of the front end of said pneumatic motor.

3. A powered hand tool as set forth in claim 2 further comprising an external isolation layer engaging the outer surface of said main body.

4. A powered hand held tool as set forth in claim 2 configured for rear end exhaust, wherein said main body rear end is further defined as including a fluid outlet, and wherein said rear cap further comprises:

a. a plurality of fluid inlet holes fashioned to communicate with said fluid inlet in said main body; and b. a plurality of fluid outlet holes fashioned to communicate with said fluid outlet in said main body rear end.

5. A powered hand held tool as set forth in claim 2 configured for front end exhaust wherein said rear cap is further defined as including a plurality of fluid inlet holes fashioned to communicate with said fluid inlet in said main body rear end, and wherein said front cap is further defined as including a plurality of fluid outlet holes.

6. A powered hand held tool as set forth in claim 2 wherein the ratio between the total axial length of said rear and front caps and the inside diameter of the main body is less than 1.

7. A powered hand held tool as set forth in claim 2 wherein the ratio between the axial length of said rear and front caps and the inside diameter of the main body is less than 1.

8. A powered hand held tool as set forth in claim 1 wherein said powered hand held tool is further defined as a die grinder.

9. A powered hand held tool as set forth in claim 1 wherein said external isolation layer is comprised of a material selected from the group consisting of an elastomeric ester based polyurethane, an ether based polyurethane, a vinyl material and combinations thereof.

10. A powered hand held tool as set forth in claim 1 wherein said external isolation layer is of a thickness between one-eighth of an inch and three-sixteenths of an inch.

11. A powered hand held tool as set forth in claim 1 wherein said main body is formed in an ergonomic wave contour and said external isolation layer follows said ergonomic wave contour.

12. A powered hand held tool as set forth in claim 1 wherein said external isolation layer is adhered to said outer surface of said main body.

13. A powered hand held tool as set forth in claim 1 wherein said external isolation layer is molded to said outer surface of said main body.

14. A powered hand held tool as set forth in claim 1 wherein an annular space exists between the radial surface of said pneumatic motor and said main body.

15. A powered hand held tool as set forth in claim 1 wherein a collett assembly is engaged with said rotary shaft.

16. A powered hand held tool as set forth in claim 15 wherein said collett assembly is coupled to a tool selected from the group consisting of a bit, a grinding wheel, a cutter and combinations thereof.

* * * * *